US008998380B2

(12) United States Patent
Fukuzawa et al.

(10) Patent No.: US 8,998,380 B2
(45) Date of Patent: Apr. 7, 2015

(54) LIQUID EJECTING HEAD, LIQUID EJECTING APPARATUS

(71) Applicant: Seiko Epson Corporation, Tokyo (JP)

(72) Inventors: Yuma Fukuzawa, Matsumoto (JP); Hiroshige Owaki, Okaya (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 14/100,291

(22) Filed: Dec. 9, 2013

(65) Prior Publication Data

US 2014/0160204 A1 Jun. 12, 2014

(30) Foreign Application Priority Data

Dec. 12, 2012 (JP) ..... 2012-271110

(51) Int. Cl.
*B41J 2/14* (2006.01)
*B41J 2/16* (2006.01)
*B41J 2/045* (2006.01)

(52) U.S. Cl.
CPC ..... *B41J 2/14233* (2013.01); *B41J 2202/11* (2013.01); *B41J 2202/20* (2013.01)

(58) Field of Classification Search
CPC ..... B41J 2/14233; B41J 2/14201; B41J 2002/14491; B41J 2/045; B41J 2/161
See application file for complete search history.

(56) References Cited

U.S. PATENT DOCUMENTS

2014/0160206 A1* 6/2014 Yamasaki ..... 347/54

FOREIGN PATENT DOCUMENTS

JP 2004-114556 A 4/2004

* cited by examiner

*Primary Examiner* — Lisa M Solomon
(74) *Attorney, Agent, or Firm* — Harness, Dickey & Pierce, P.L.C.

(57) ABSTRACT

A liquid ejecting head includes a nozzle plate, a flow path forming substrate, and a communication plate between the nozzle plate and the substrate and having a communication hole connecting a nozzle and a first opening of a pressure chamber. The first opening extends in a direction perpendicular to an arrangement direction of the pressure chambers. The first opening has a narrowed portion close to the communication hole. The communication hole has at least three edge lines which extend in a penetration direction. The communication plate is bonded to the substrate such that the ends of the edge lines at a surface close to the substrate are covered with the substrate that defines the narrowed portion on a surface close to the communication plate.

5 Claims, 7 Drawing Sheets

LIQUID EJECTING HEAD, LIQUID EJECTING APPARATUS

BACKGROUND

1. Technical Field

The present invention relates to liquid ejecting heads that eject liquid through nozzles, and more specifically to liquid ejecting heads in which liquid flow paths are formed by bonding a plurality of substrates to each other.

2. Related Art

Liquid ejecting heads that eject a liquid such as ink through nozzles are known. A liquid ejecting head includes piezoelectric elements that deform in response to the applied voltage, flow paths through which liquid flows and nozzles that communicate with the flow paths and allow the liquid to be ejected through the nozzles. Accordingly, when a pressure is generated in the flow paths due to deformation of the piezoelectric elements, the pressure causes the liquid flowing through the flow paths to be ejected through the nozzle openings. Such a liquid ejecting head is used, for example, as part of the printing apparatus or the like.

Further, liquid ejecting heads in which flow paths are formed by bonding a plurality of stacked substrates so that liquid flows through the flow paths. For example, the flow paths are formed by stacking a nozzle plate in which nozzles are formed, a flow path forming substrate having piezoelectric elements and pressure chambers in which a pressure is generated by the piezoelectric elements, and a communication plate in which communication holes are formed so as to communicate the nozzles and the pressure chambers with each other, and bonding the substrates by using an adhesive. The flow paths for the liquid are formed inside the bonded substrates.

When a plurality of substrates are bonded by using an adhesive to form the flow paths, the adhesive may flow out from between the substrates and the flowed out adhesive may cure inside the flow path. When the liquid ejecting head is actuated, the adhesive may be peeled off inside the flow path, leading to nozzle clogging. The nozzle clogging causes ejection failure of the liquid ejecting head. JP-A-2004-114556 discloses the prevention of ejection failure by cleaning the adhesive inside the flow path by using a solvent or the like.

It has been difficult to completely remove the adhesive inside the flow path when the adhesive is cleaned by using a solvent. Although it is possible to provide a form on the inner wall of the flow path in order to prevent the adhesive from creeping up on the wall, this requires precise designing of the form dimensions depending on the viscosity or applied amount of the adhesive. Such precise designing of dimensions may limit the design freedom of the flow path.

SUMMARY

An advantage of some aspects of the invention is that the liquid ejecting head capable of reducing the failure in ejection due to nozzle clogging and the liquid ejecting apparatus having the same are provided.

According to an aspect of the invention, a liquid ejecting head includes a nozzle plate having a plurality of nozzles through which liquid is ejected, a flow path forming substrate having a plurality of pressure chambers which are arranged side by side in a first direction, each of the pressure chambers having a first opening provided on a bottom surface, and a piezoelectric element which is provided adjacent the pressure chamber, and a communication plate that is located between the nozzle plate and the flow path forming substrate and has a communication hole which communicates the nozzle and the first opening of the pressure chamber with each other, the nozzle plate, the flow path forming substrate and the communication plate being bonded to each other, wherein the first opening on the flow path forming substrate has a longitudinal direction in a second direction which is perpendicular to the first direction and extends from an ink supply side to the communication hole, and, in the longitudinal direction, the first opening has a narrowed portion at a portion close to the communication hole, the narrowed portion having an inner width of the pressure chamber in the first direction which is smaller than the inner width of a portion on the ink supply side, the communication hole of the communication plate has at least three edge lines which extend in a penetration direction, and the communication plate is bonded to the flow path forming substrate such that ends of the edge lines at a surface close to the flow path forming substrate are covered with the flow path forming substrate that defines the narrowed portion on a surface close to the communication plate.

In the above configuration, an adhesive that bonds the nozzle plate and the communication plate may flow out from between the substrates and creep up along the edge lines inside the communication hole. However, when the adhesive creeps up along the edge lines and reaches the flow path forming substrate, the adhesive is blocked by the surface of the flow path forming substrate close to the communication plate, since the edge lines of the communication hole at the surface close to the flow path forming substrate are covered with the flow path forming substrate on the bottom surface that defines the narrowed portion of the pressure chamber. The blocked adhesive merges with the adhesive which bonds the flow path forming substrate and the communication plate, and integrally cures. It is known that the cured adhesive tends to be peeled off at the edge portion. Accordingly, the adhesive is prevented from being peeled off at the edge portion by integrally curing the adhesive inside the flow path. By avoiding the edge portion from being formed, the risk that the adhesive is peeled off inside the flow path can be reduced, thereby reducing nozzle clogging caused by the peeled adhesive. In addition, since it is not necessary to consider the prevention of the adhesive from creeping up inside the flow path, the need of precisely designing the form of flow path depending on the applied amount of adhesive can be eliminated.

According to the above aspect of the invention, the communication hole may have a second opening that is open to the surface close to the flow path forming substrate and a third opening that is open to a surface close to the nozzle plate, and a narrow flow path may be formed at a position between the second opening and the third opening of the communication hole, the narrow flow path having an inner width in the first direction which is smaller than an inner width of either the second opening or the third opening. In the above configuration, the wall between the adjacent communication holes becomes thin when the inner width of the communication hole in the first direction is increased in relation to the narrowed portion of the flow path forming substrate. As a result, a problem of crosstalk may occur. When one of the adjacent communication holes deforms, another communication hole may deform due to the crosstalk, which effects on the ejection timing of the liquid. In order to avoid such a problem, the narrow flow path is provided in the communication hole. Accordingly, in the direction in which the communication hole extends, the thickness of the wall that defines the communication hole varies in the first direction, thereby preventing deformation of the wall. As a consequence, it is possible to prevent the crosstalk. Moreover, the prevention of crosstalk enables the communication holes to be closely arranged. Accordingly, the nozzles can be arranged with high density.

The communication hole may have a resistance adjustment portion having an inner width in the second direction which is larger than an inner width of the second opening in the second direction, the second direction being perpendicular to the first direction. In the above configuration, the resistance adjustment portion provided inside the communication hole may increase the flow path resistance in the flow path extending from the pressure chamber to the communication hole. In order to avoid such a problem, the communication hole may have the resistance adjustment portion having an increased inner width in the second direction at a portion in the flow path close to the nozzle plate, thereby reducing the flow path resistance.

The communication hole may be formed in a rectangular shape having four edge lines. Accordingly, it is possible to form the communication hole with ease by etching process or the like.

According to another aspect of the invention, a liquid ejecting apparatus may include the liquid ejecting head according to the above aspect of the invention.

According to the another aspect of the invention, a liquid ejecting head includes a nozzle plate having a plurality of nozzles through which liquid is ejected, a flow path forming substrate having a plurality of pressure chambers which are arranged side by side in a first direction, each of the pressure chambers having a first opening provided on a bottom surface, and a piezoelectric element which is provided adjacent the pressure chamber, and a communication plate that is located between the nozzle plate and the flow path forming substrate and has a communication hole which communicates the nozzle and the first opening of the pressure chamber with each other and has walls that intersect an acute or obtuse angle, the nozzle plate, the flow path forming substrate and the communication plate being bonded to each other, wherein the first opening on the flow path forming substrate has a longitudinal direction in a second direction which is perpendicular to the first direction and extends from an ink supply side to the communication hole, the communication hole of the communication plate has at least three edge lines which are formed at intersections of the walls and extend in a penetration direction, and has a second opening on a surface close to the flow path forming substrate, the communication plate is bonded to the flow path forming substrate such that at least two ends of the edge lines at the second opening are covered with the flow path forming substrate that defines the first opening on a surface close to the communication plate, and the communication hole may have a step which is formed on the edge line between the walls that intersect at an obtuse angle so that the edge line has a discontinuity.

In the above configuration, a step is formed in the communication hole on the edge line having the end which is not covered with the surface of the flow path forming substrate close to the communication plate, so that the edge line has a discontinuity. Accordingly, the step can prevent the adhesive from creeping up toward the flow path forming substrate, thereby reducing nozzle clogging caused by the peeled adhesive.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of the invention will be described below in the following order:

1. First embodiment
2. Second embodiment
3. Other embodiments

1. First Embodiment

Figure 1:
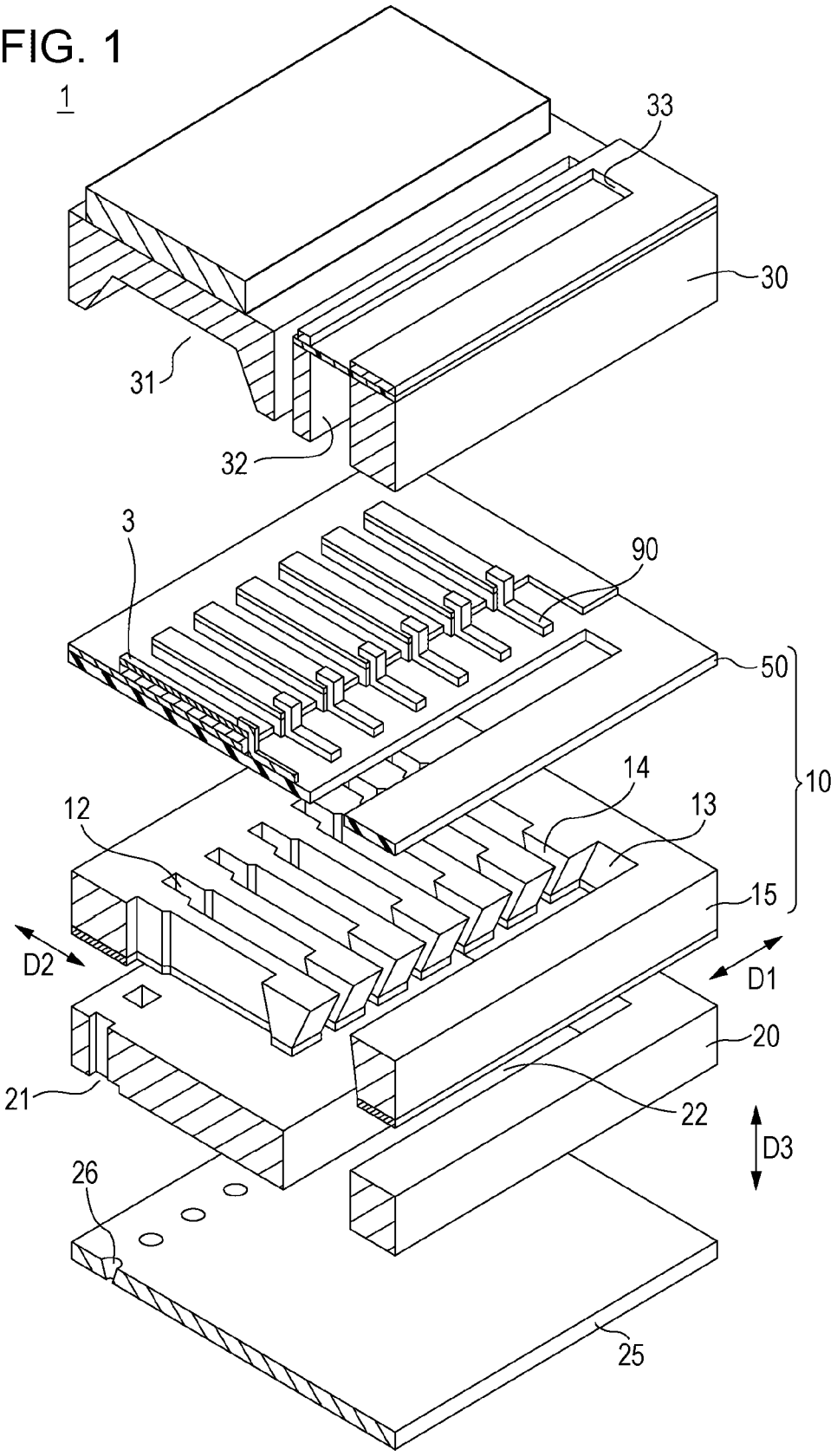
FIG. 1 is an exploded perspective view of a liquid ejecting head according to a first embodiment of the invention.
Figure 2A:
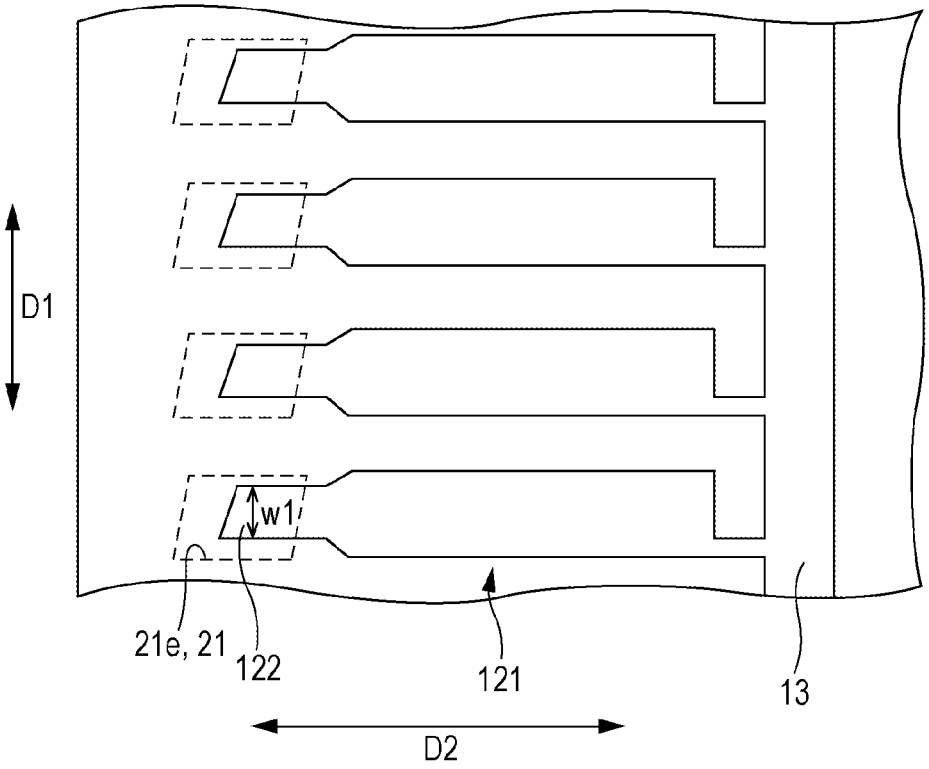
FIGS. 2A and 2B are views which show a positional relationship between a pressure chamber and a communication hole.
Figure 2B:
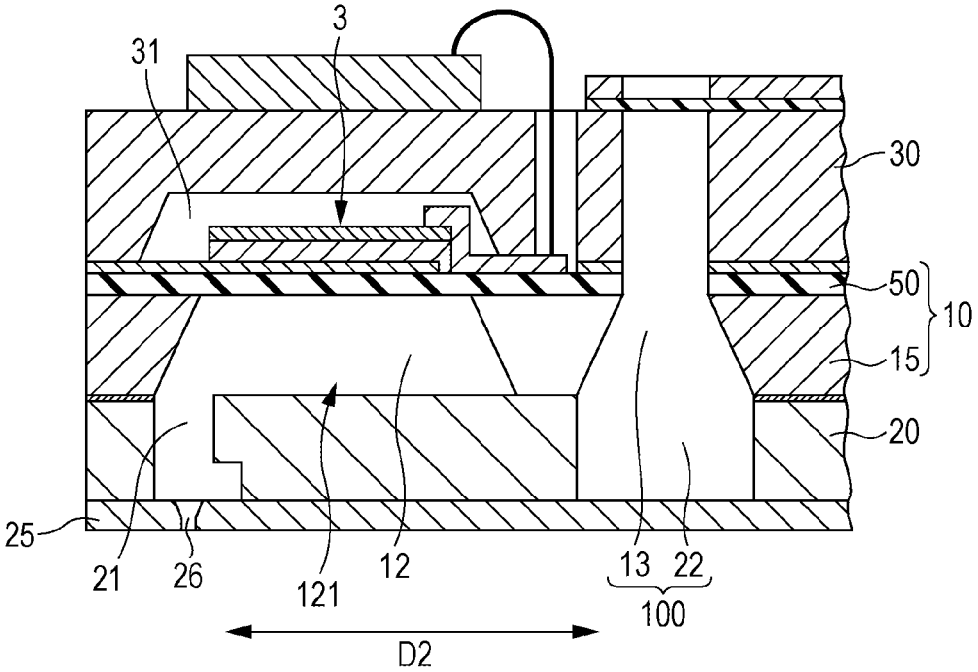

FIG. 1 is an exploded perspective view of a liquid ejecting head 1 according to a first embodiment of the invention. FIGS. 2A and 2B are views which show a positional relationship between a pressure chamber and a communication hole.

The liquid ejecting head 1 according to this embodiment is used as part of a liquid ejecting apparatus that ejects a liquid such as ink. As shown in FIG. 1, the liquid ejecting head 1 includes a nozzle plate 25, a communication plate 20, a flow path forming substrate 10 and a sealing substrate 30. In the figures, for better understanding of the configuration of the flow path forming substrate 10, the flow path forming substrate 10 is shown as being separated into two parts.

The liquid ejecting head 1 is composed of at least the flow path forming substrate 10, the communication plate 20 and the nozzle plate 25, which are bonded to each other by using an adhesive. When those substrates are bonded to each other by using an adhesive, ink flow paths are formed by pressure chambers 12 that are formed in the flow path forming substrate 10, communication holes 21 that are formed in the communication plate 20 and nozzles 26 that are formed in the nozzle plate 25, which communicate with each other. In this embodiment, a direction in which the pressure chambers 12 are arranged side by side is hereinafter referred to as a first direction D1 and a direction which is perpendicular to the first direction is hereinafter referred to as a second direction D2. Further, a direction in which the communication holes 21 extend is hereinafter referred to as a third direction D3.

The flow path forming substrate 10 is composed of, for example, a silicon single crystal substrate having plane orientation (110). An elastic film 50 having 1-2 μm thickness which is previously formed of thermally oxidized silicon dioxide is formed on one surface of the flow path forming substrate 10. A plurality of pressure chambers 12 are arranged side by side in the width direction (the first direction D1) in the flow path forming substrate 10. Further, a reservoir section 13 is disposed outside of the pressure chambers 12 in the second direction D2 which is perpendicular to the first direction D1 in the flow path forming substrate 10 such that the reservoir section 13 and the respective pressure chambers 12 communicate with each other through ink supply paths 14 which are provided for each of the pressure chambers 12. The pressure chambers 12, the reservoir section 13 and the ink supply paths 14 penetrate the flow path forming substrate 10 in the thickness direction. Each ink supply path 14 has a width which is smaller than that of each pressure chamber 12 and keeps a flow path resistance of ink flowing from the reservoir section 13 to the pressure chamber 12 to be constant.

FIG. 2A is a perspective view which shows an inside of the flow path forming substrate 10. Each pressure chamber 12 has a bottom surface opening (hereinafter, also referred to as a first opening 121) that extends in the second direction D2 which is perpendicular to the first direction D1 on the flow path forming substrate 10. That is, each first opening 121 has a longitudinal direction in the second direction D2 and extends from the reservoir section 13 (an ink supply side) to the communication hole 21. Accordingly, one end (the left end in the figure) of the first opening 121 is located near the immediately upper position of the communication hole 21. Further, a narrowed portion 122 is formed at a portion of the first opening 121 which is located at an upper position of the communication hole 21. The narrowed portion 122 has an inner width (w1 in the figure) which is smaller than the width of a second opening 21*e*, which will be described later, in the first direction D1. In this embodiment, the narrowed portion 122 is formed by providing narrowed inner width at the end portion of the first opening 121. However, the entire inner width of the first opening 121 in the first direction D1 may be smaller than the inner width of the communication hole 21 in the first direction D1.

As shown in FIGS. 1 and 2B, the communication plate 20 is bonded to the bottom surface of the flow path forming substrate 10 by using an adhesive. The communication plate has the communication holes 21 that penetrate the communication plate 20. The communication holes 21 are arranged side by side in the first direction D1. Further, the communication plate 20 has a communication section 22 which penetrate the communication plate 20 in the third direction D3 at a position which opposes the reservoir section 13 of the flow path forming substrate 10 such that the communication section 22 communicates with the reservoir section 13 of the flow path forming substrate 10. The reservoir section 13 and the communication section 22 form a reservoir 100 which serves as an ink chamber for all the pressure chambers 12. Although the communication plate 20 of this embodiment is made of a silicon single crystal substrate, the communication plate 20 can be made of any material.

Figure 3A:
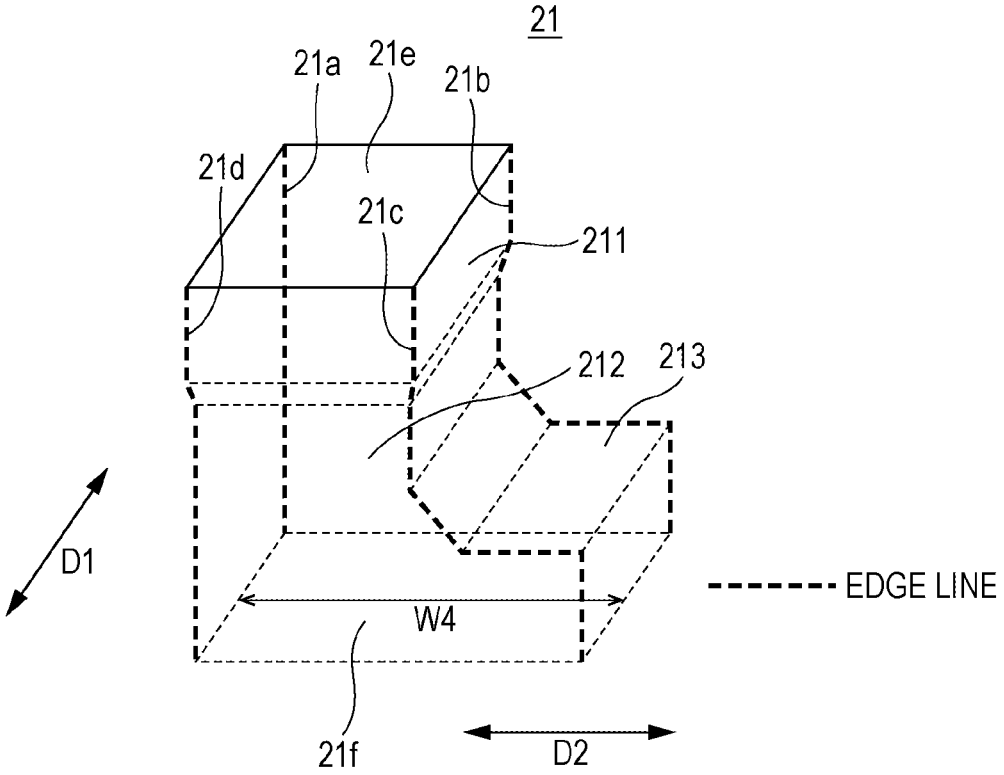
FIGS. 3A and 3B are views which show a configuration of a communication hole.
Figure 3B:
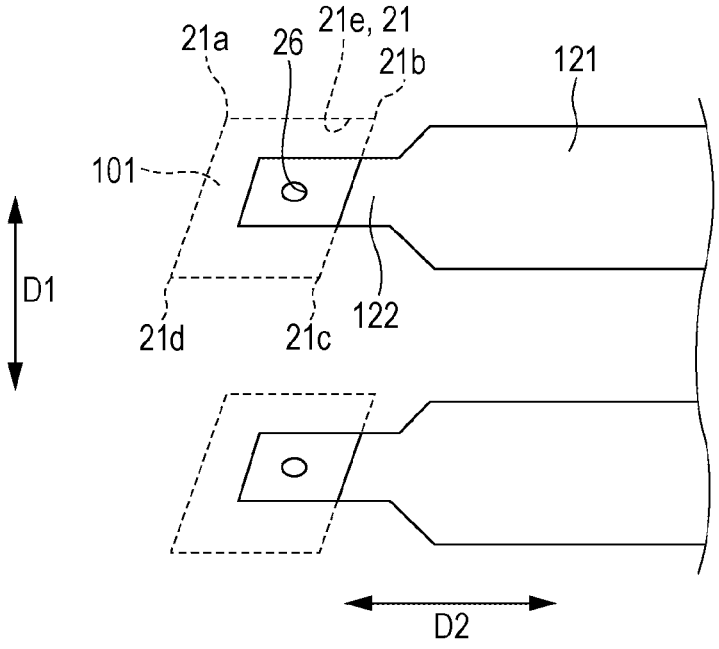
Figure 4:
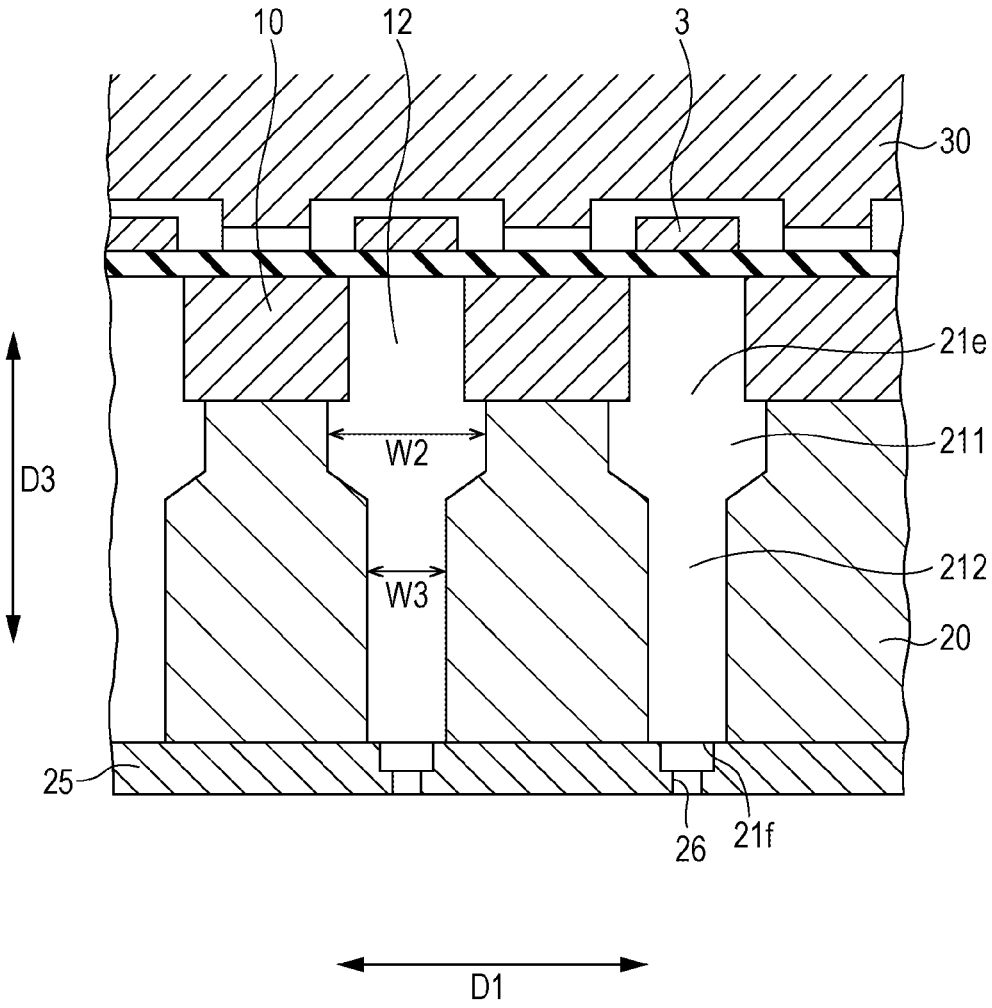
FIG. 4 is a view which shows a configuration of the communication hole.

FIGS. 3A, 3B and 4 are views which show a configuration of a communication hole 21. As shown in FIG. 3A, the communication hole 21 is formed as a rectangular hole which is surrounded by four walls that extend in a penetration direction (the third direction D3). Four edge lines 21*a* to 21*d* are formed at intersections of the walls. Since the communication hole 21 penetrates the communication plate 20, the second opening 21*e* and a third opening 21*f* are provided on each of the both surfaces of the communication plate 20. The second opening 21*e* is provided on the surface of the communication plate 20 which is bonded to the flow path forming substrate 10 and communicates with the first opening 121 of the flow path forming substrate 10. Further, the third opening 21*f* is provided on the surface of the communication plate 20 which is bonded to the nozzle plate 25 and communicates with the nozzle 26 of the nozzle plate 25. In this embodiment, a length of the communication hole 21 in the third direction D3 is 300 μm.

A wide flow path 211 having an inner width w2 in the first direction D1 is provided at a portion of the flow path in the communication hole 21 which includes the second opening 21*e*. Further, a narrow flow path 212 having an inner width w3 in the first direction D1 which is smaller than the inner width w2 of the wide flow path 211 in the first direction D1 is provided at a portion of the flow path immediately under the wide flow path 211. In this embodiment, the wide flow path 211 is provided at a portion of the communication hole 21 which extends by 100 μm in the third direction D3 from the second opening 21*e*, while the narrow flow path 212 is provided at the remaining portion. FIG. 4 shows an inside of the communication plate 20 which is seen in the second direction D2. Portions of the communication plate 20 which define the respective communication holes 21 at positions which correspond to the wide flow paths 211 have a small wall thickness, while portions of the communication plate 20 which define the respective communication holes 21 at positions which correspond to the narrow flow paths 212 have a large wall thickness. That is, the thickness of the wall in the first direction D1 which defines the communication holes 21 varies in the third direction D3.

Further, a resistance adjustment portion 213 having an inner width w4 in the second direction D2 which is larger than that of the remaining portion of the communication hole 21 is provided at a portion of the communication hole 21 on the side of the third opening 21*f* is provided. In this embodiment, the resistance adjustment portion 213 is provided at a portion of the communication hole 21 which extends by 100 μm in the third direction D3 from the third opening 21*f*.

Although not described herein, all the communication holes 21 provided on the communication plate 20 have the same shape as that is shown in FIGS. 3A, 3B and 4. Further, although the above communication holes 21 are formed by wet etching the communication plate 20 by using a mask pattern, the communication holes 21 may be manufactured by any technique.

FIG. 3B is a view of an interface where the communication hole 21 of the communication plate 20 and the first opening 121 of the flow path forming substrate 10 abut as seen from the flow path forming substrate 10. At the interface where the communication hole 21 of the communication plate 20 and the first opening 121 of the flow path forming substrate 10 abut, each of the ends of the four edge lines 21*a* to 21*d* at the second opening 21*e* of the communication hole 21 are covered by the bottom surface 101 of the flow path forming substrate 10 which defines the narrowed portion 122. That is, when the communication plate 20 and the flow path forming substrate 10 are bonded to each other so as to that communicate the narrowed portion 122 and the second opening 21*e* with each other, the ends of the four edge lines 21*a* to 21*d* abut against an area near the perimeter of the first opening 121 (on the bottom surface 101) since the inner width w1 of the narrowed portion 122 in the first direction D1 is smaller than the inner width w2 of the second opening 21*e*.

Referring back to FIGS. 1, 2A and 2B, the nozzle plate 25 is bonded by an adhesive to the surface of the communication plate 20 which is not bonded to the flow path forming substrate 10. The nozzles 26 are formed so as to penetrate the nozzle plate 25 at positions which correspond to the respective pressure chambers 12. The nozzle plate 25 is formed of a glass ceramics, a silicon single crystal substrate or a stainless steel having a thickness, for example, in the range of 0.05 to 1 mm and a coefficient of linear expansion of, for example, 2.5 to 4.5 [×10−6/° C.] under the temperature of 300 degrees or lower.

Further, piezoelectric elements 3 which correspond to the respective pressure chambers 12 are provided on the flow path forming substrate 10. Each piezoelectric element 3 is composed of, for example, a lower electrode film having an approximately 0.2 μm thickness, a piezoelectric layer having an approximately 1.0 μm thickness, and an upper electrode film having an approximately 0.05 μm thickness, which are stacked in sequence. Generally, one of the electrodes of the piezoelectric element 3 is provided as a common electrode and the other of the electrodes and the piezoelectric layer are formed by patterning for each of the pressure chambers 12. Accordingly, the piezoelectric active portions are formed for each of the pressure generating chambers. The piezoelectric element 3 and a vibration plate that deforms by driving the piezoelectric element 3 are collectively referred to as a piezoelectric actuator.

Further, lead electrodes 90 which are formed of a material such as gold (Au) are provided to be connected with the respective piezoelectric elements 3. The lead electrodes 90 extend from areas which oppose the pressure chambers 12 to the outside of the pressure chambers 12 with the end portions of the lead electrodes 90 being exposed in the through hole of the sealing substrate 30, which will be described later. A compliance member 33 is disposed at a position which corresponds to the reservoir section 13 of the flow path forming substrate 10 such that the opening of the reservoir 13 on one side is sealed by the compliance member 33.

The sealing substrate 30 is bonded by an adhesive to the surface of the flow path forming substrate 10 on which the piezoelectric elements 3 are disposed. The sealing substrate 30 includes a piezoelectric element holding section 31 that provides a space which does not interfere with movement of the piezoelectric elements 3 at a position which opposes the piezoelectric elements 3. The space is sealed by the piezoelectric element holding section 31 when the sealing substrate 30 is bonded to the flow path forming substrate 10. The sealing substrate 30 also includes a recess 32 that provides a depth which does not interfere with deformation of the compliance member 33 at a position which opposes the reservoir section 13. The sealing substrate 30 is preferably made of a material such as a glass, ceramic, metal and plastic, and is more preferably made of a material having the substantially same coefficient of linear expansion as that of the flow path forming substrate 10, for example, a silicon single crystal substrate.

A wiring pattern which is composed of a wiring film which is made of, for example, gold (Au) is formed on the sealing substrate 30 via an insulating film which is made of, for example, silicon dioxide. Further, a drive IC that actuates the piezoelectric elements 3 is mounted on the wiring pattern.

In the liquid ejecting head of this embodiment, ink is supplied from an external ink supply unit, which is not shown in the figure. After the flow path from the reservoir 100 to the nozzles 26 is filled with ink, the respective piezoelectric elements 3 which correspond to the pressure chambers 12 are actuated in response to recording signals from the drive IC, thereby increasing the pressure in the respective pressure chambers 12 and allowing ink droplets to be ejected from the nozzles 26.

Figure 5:
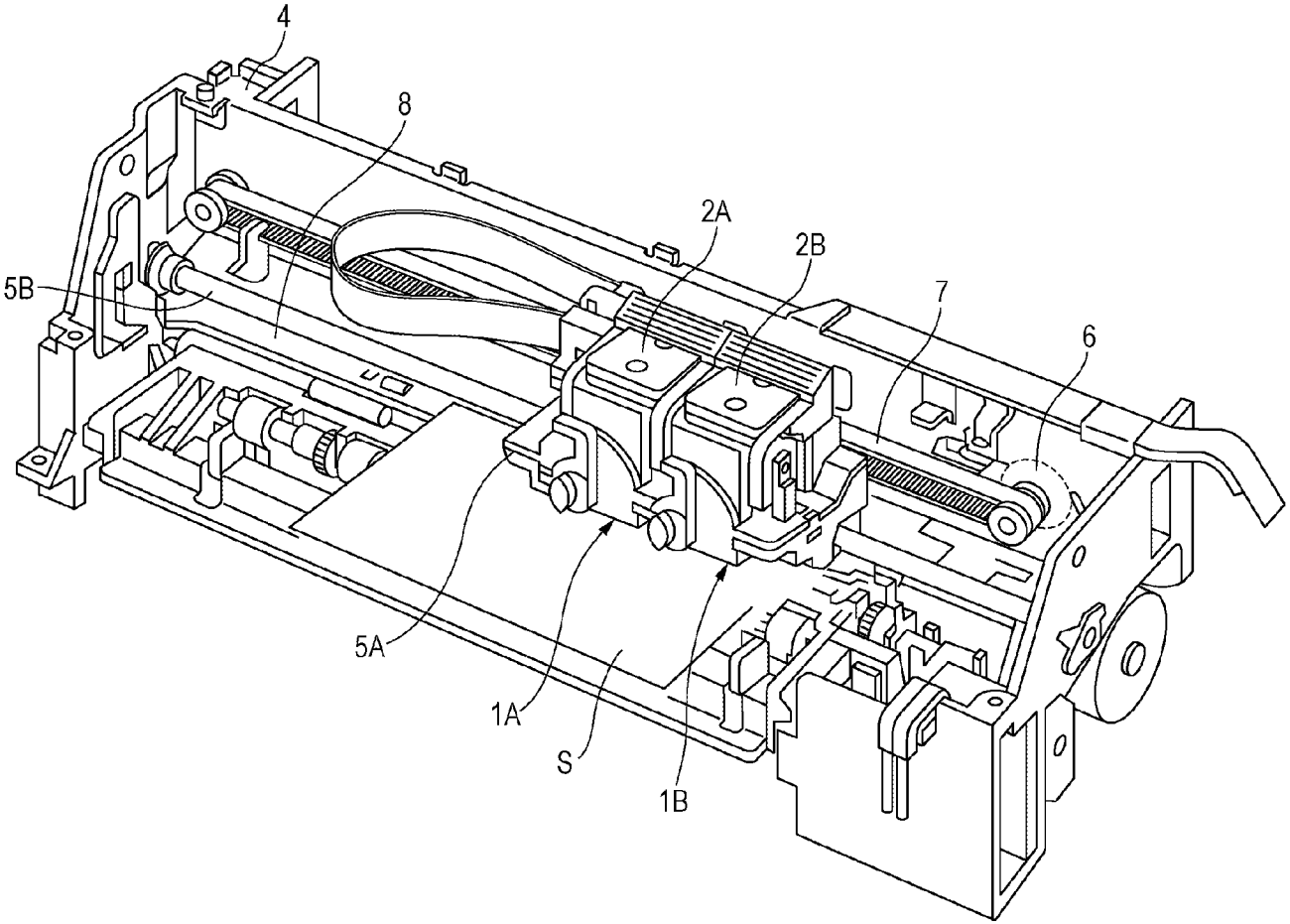
FIG. 5 is a schematic view which shows an example of ink jet recording apparatus.

The liquid ejecting head according to this embodiment is mounted in the ink jet recording apparatus and constitutes part of the recording head unit which is provided with ink flow paths that communicate with ink cartridges and the like. FIG. 5 is a schematic view which shows an example of ink jet recording apparatus. As shown in FIG. 5, recording head units 1A and 1B that include an ink jet recording head are mounted on a carriage 5A, and cartridges 2A and 2B which constitute ink supply units are removably mounted on the recording head units 1A and 1B. The carriage 5A is movable in the axis direction on a carriage shaft 5B which is provided on an apparatus body 4. The recording head units 1A and 1B are configured to eject, for example, black ink composition and color ink composition, respectively. When a drive force from a drive motor 6 is transmitted to the carriage 5A via a plurality of gears, which are not shown in the figure, and a timing belt 7, the carriage 5A on which the recording head units 1A and 1B are mounted moves along the carriage shaft 5B. Further, the apparatus body 4 is provided with a platen 8 which extends along the carriage shaft 5B. A recording sheet S which is a recording medium such as a sheets of paper which has been fed from feed rollers and the like, which are not shown in the figure, is transported while being wound around the platen 8.

Figure 6:
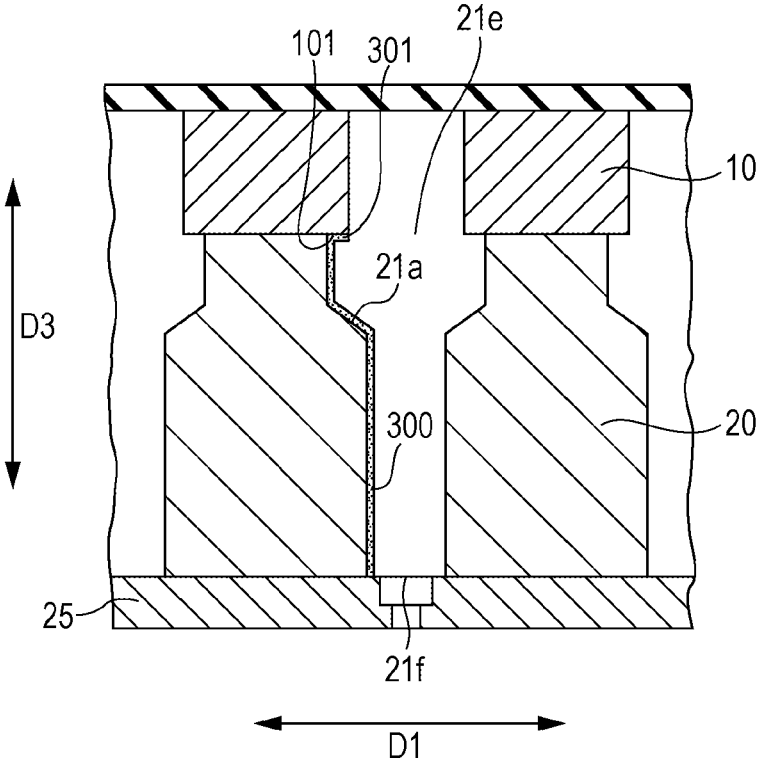
FIG. 6 is a view which explains movement of an adhesive inside a flow path.

FIG. 6 is a view which explains movement of an adhesive inside the flow path. The following explains the effect of the nozzle plate 25, the communication plate 20 and the flow path forming substrate 10 in the foregoing liquid ejecting head 1 on an adhesive when they are bonded to each other by using the adhesive.

First, the nozzle plate 25 is bonded by an adhesive 300 to the surface of the communication plate 20 on which the third opening 21*f* is provided, and the bottom surface 101 of the flow path forming substrate 10 is bonded by an adhesive 301 to the surface of the communication plate 20 on which the second opening 21*e* of the communication hole 21 is provided. The adhesive such as a thermosetting epoxy adhesive is advantageously used. In practice, a wafer substrate is formed by bonding the flow path forming substrate 10, the communication plate 20, the nozzle plate 25 and the sealing substrate 30 by using the adhesive so as to provide a plurality of liquid ejecting heads 1, and then, the wafer substrate is cut into individual liquid ejecting heads 1.

The adhesive 300 may flow out from between the nozzle plate 25 and the communication plate 20 toward the inside of the communication hole 21. Once the adhesive 300 flows out, the adhesive 300 creeps up along the edge lines 21*a* to 21*d* inside the communication hole 21 toward the flow path forming substrate 10 (for ease of explanation, only the 21*a* is shown in FIG. 6).

When the adhesive 300 creeps up along the edge line 21*a* and reaches the flow path forming substrate 10, the adhesive 300 is blocked by the bottom surface 101 since the second opening 21*e* of the communication hole 21 is covered with the bottom surface 101 that defines the first opening 121 of the pressure chamber 12 of the flow path forming substrate 10. The blocked adhesive 300 merges with the adhesive 301 which flowed out from between the flow path forming substrate 10 and the communication plate 20. Then, the adhesive 300 cures along the edge line 21*a* of the communication hole 21 which extends between the nozzle plate and the bottom surface 101 of the flow path forming substrate 10. That is, since the adhesive 300 that bonds the nozzle plate 25 and the communication plate 20 and the adhesive 301 that bonds the communication plate 20 and the flow path forming substrate 10 integrally cure, no edge portion is formed on the adhesives 300, 301.

The effect caused by the edge portion of the adhesives 300, 301 will be described in comparison with the conventional art. If the edge lines 21*a* to 21*d* are not provided in the communication hole 21 and the flow of adhesive 300 stops halfway inside the communication hole 21, an edge portion is formed on the adhesive 300. As a result, when the cured edge portion is infiltrated with ink which flows inside the flow path, the adhesive 300 may be peeled off at the edge portion. By avoiding the edge portion from being formed on the adhesive 300, the risk that the adhesive 300 is peeled off inside the flow path can be reduced, thereby reducing nozzle clogging caused by the peeled adhesive. In addition, since it is not necessary to consider the prevention of creeping up of the adhesive 300 inside the flow path, there is no need of precisely designing a step or the like depending on the applied amount of adhesive, and the flow path can be designed with a high degree of freedom.

FIG. 4 shows a cross section of the communication hole 21 as seen in the second direction D2. Since the narrow flow path 212 is provided in the communication hole 21, the thickness of the wall in the first direction D1 that defines the communication hole 21 varies in the third direction D3. The varying thickness of the wall can prevent the wall from being deformed. Accordingly, when a force is generated by deformation of adjacent pressure chambers 12 and is transmitted to the communication hole 21, it is possible to reduce transmission of the force to other pressure chambers which is not in communication with the pressure chamber 12, thereby preventing crosstalk between the communication holes. Moreover, the prevention of crosstalk between the communication holes enables the communication holes to be closely arranged. Accordingly, the nozzles can be arranged with high density on the liquid ejecting head 1.

Further, since the resistance adjustment portion 213 having a width in the second direction D2 which is larger than that of the remaining portion is provided in the communication hole 21 at a position close to the third opening 21*f*, the flow path resistance in the communication hole 21 caused by the presence of the narrow flow path 212 can be decreased. That is, as the volume of the communication hole 21 decreases, ink may be difficult to flow through the communication hole 21 due to difference between the flow path resistance of the pressure chamber 12 and the flow path resistance of the communication hole 21. By providing the resistance adjustment portion 213 in the communication hole 21, the flow path resistance in the communication hole 21 can be decreased, thereby facilitating the flow of ink. Moreover, since the resistance adjustment portion 213 is formed as having a larger width in the second direction D2 in the communication hole 21, the thickness of the wall in the first direction D1 that defines the communication hole 21 remains the same. Accordingly, the resistance adjustment portion 213 does not effect on the crosstalk.

2. Second Embodiment

Figure 7A:
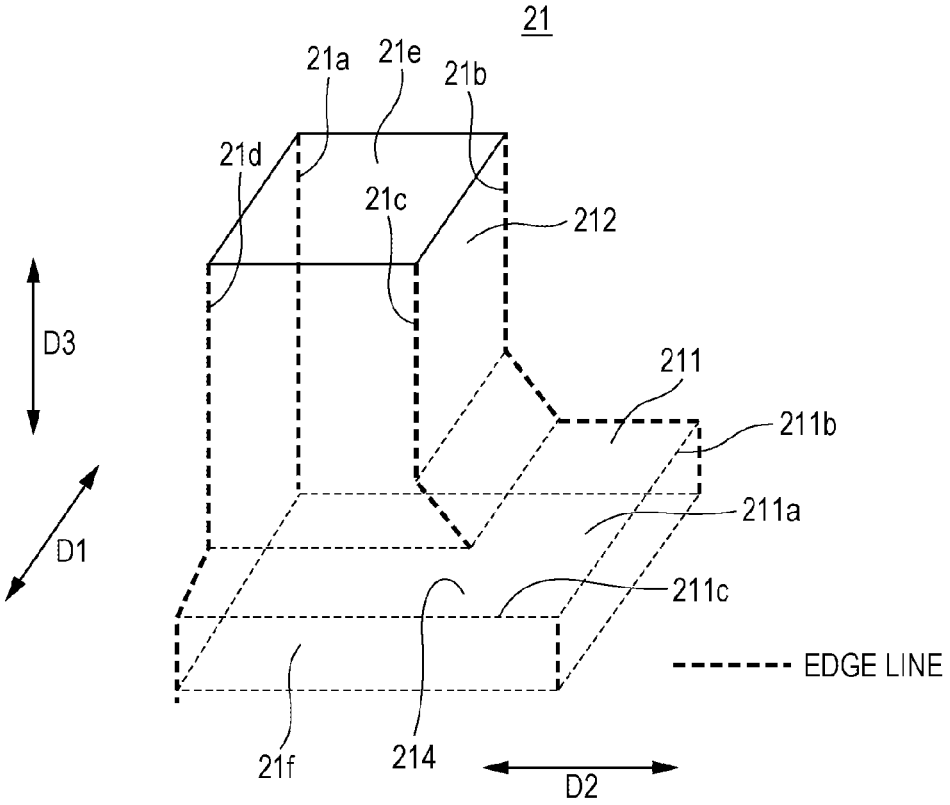
FIGS. 7A and 7B are views which show a configuration of a communication hole and a pressure chamber according to a second embodiment.
Figure 7B:
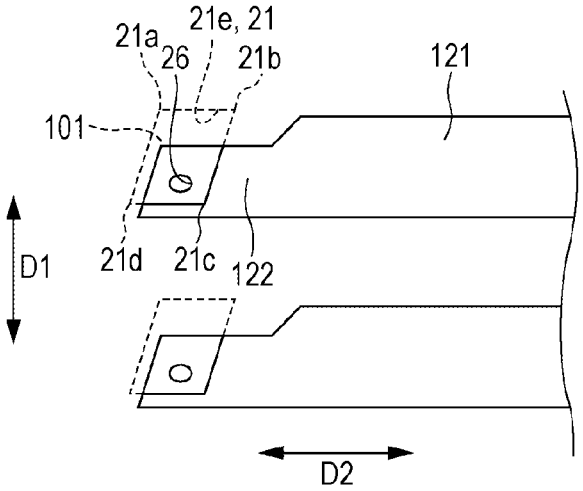

FIGS. 7A and 7B are views which show a configuration of the communication hole 21 and the pressure chamber 12 according to the second embodiment. In the second embodiment, instead of all the ends of the edge lines, only some of the ends of the edge lines at the second opening 21*e* are covered with the bottom surface 101 of the flow path forming substrate 10. On the edge line having the end which is not covered with the flow path forming substrate 10, a step is formed at a position between the second opening 21*e* and the third opening 21*f* so that the edge line has a discontinuity. Since the edge line has the discontinuity, the adhesive can be prevented from creeping up along the edge line.

As shown in FIG. 7A, the communication hole 21 is formed by a rectangular hole which extends in the third direction D3. The hole is surrounded by the walls which intersect at an acute or obtuse angle. Four edge lines 21*a* to 21*d* are formed at intersections of the walls. Further, the second opening 21*e* and a third opening 21*f* are provided on each of the both surfaces of the communication plate 20.

The wide flow path 211 is provided in the communication hole 21 on the side of the third opening 21*f*. Further, the narrow flow path 212 is provided at a portion of the communication hole 21 which includes the second opening 21*e*. As shown in FIG. 7A, the wide flow path 211 having a larger width both in the first direction D1 and the second direction D2 is provided at a portion of the communication hole 21 which extends from the third opening 21*f* by a predetermined length in the third direction D3. Accordingly, the wide flow path 211 also serves as a resistance adjustment portion.

The communication hole 21 includes the narrow flow path 212 which includes the second opening 21*e* at a position immediately above the wide flow path 211. Accordingly, similar to the first embodiment, portions of the communication plate 20 which define the respective communication holes 21 at positions which correspond to the wide flow paths 211 in the second direction D2 have a small wall thickness, while portions of the communication plate 20 which define the respective communication holes 21 at positions which correspond to the narrow flow paths 212 have a large wall thickness. That is, similar to the first embodiment, the thickness of the wall in the first direction D1 that defines the communication holes 21 varies in the third direction D3, thereby reducing crosstalk between the flow paths.

With the above configuration of the communication hole 21, the edge lines 21*a*, 21*b*, 21*d* remain continuous, while the edge line 21*c* which is formed between the walls that intersect at an obtuse angle becomes discontinuous at the junction of the narrow flow path 212 and the wide flow path 211. Specifically, the edge line 21*d* has a discontinuity at a position close to the third opening 21*f* due to a step 214 which is formed by an upper surface 211*a* of the wide flow path 211. The sides 211*b*, 211*c* that define the upper surface 211*a* are continuous with the edge lines 21*b*, 21*d*. Although not described herein, all the communication holes 21 provided on the communication plate 20 have the same shape as that is shown in FIGS. 7A and 7B.

FIG. 7B is a view of an interface where the communication hole 21 of the communication plate 20 and the first opening 121 of the flow path forming substrate 10 abut as seen from the flow path forming substrate 10. In the first opening 121, the narrowed portion 122 having an inner width in the first direction D1 which is smaller than that of the remaining portion of the first opening 121 is formed. In this embodiment, the narrowed portion 122 is formed by bending a portion of the side in the longitudinal direction of the first opening 121. However, the inner width of the narrowed portion 122 in the first direction D1 may not be necessarily smaller than the inner width of the second opening 21*e* in the first direction D1.

At the interface where the communication hole 21 of the communication plate 20 and the first opening 121 of the flow path forming substrate 10 abut, each of the ends of the three edge lines 21*a*, 21*b*, 21*d* at the second opening 21*e* are covered by the bottom surface 101 of the flow path forming substrate 10 which defines the narrowed portion 122. The end of the edge line 21*c* at the second opening 21*e* is located in the opening of the first opening 121 and is not covered. As described above, the edge line 21*c* inside the first opening 121 has a discontinuity due to the step 214 which is formed at the junction of the narrow flow path 212 and the wide flow path 211 of the communication hole 21.

The following explains the effect of the nozzle plate 25, the communication plate 20 and the flow path forming substrate 10 in the liquid ejecting head according to the second embodiment on an adhesive when they are bonded to each other by using the adhesive.

Similar to the first embodiment, the adhesive creeping up along the edge lines 21*a*, 21*b*, 21*d* is blocked by the bottom surface 101 of the flow path forming substrate 10. The blocked adhesive merges with the adhesive which flowed out from between the flow path forming substrate 10 and the communication plate 20. Then, the adhesive cures along each of the edge lines of the communication hole 21 which extends between the nozzle plate 25 and the bottom surface 101 of the flow path forming substrate 10.

The adhesive which flowed out from between the nozzle plate 25 and the communication plate 20 and creeps up along the edge line 21*c* reaches the upper surface 211*a* of the wide flow path 211. However, since the edge line is discontinuous due to the step 214 which is formed at the junction of the wide flow path 211 and the narrow flow path 212, the adhesive does not creep up toward the second opening 21*e*. Further, since the edge line 21*c* has an obtuse angle, the thickness of the adhesive which creeps up the edge line 21*c* decreases. Further, the adhesive may creep to the edge lines 21*b*, 21*d* via the sides 211*b*, 211*c* that define the upper surface 211*a* of the wide flow path 211 and merges with the adhesive that creeps up along the edge lines 21*b*, 21*d*. The merged adhesive integrally cures along the sides 211*b*, 211*c* of the upper surface 211*a* and the edge lines 21*b*, 21*d*. Accordingly, the risk that the adhesive is peeled off inside the flow path can be reduced, thereby reducing nozzle clogging caused by the peeled adhesive.

In the second embodiment, all the ends of the edge lines at the second opening 21*e* are not necessarily covered with the bottom surface 101 of the flow path forming substrate 10. Accordingly, the position and the size of opening of the first opening 121 and the second opening 21*e* can be designed more freely compared to the first embodiment, thereby increasing a degree of freedom in flow path design.

3. Other Embodiments

Although the embodiments of the invention have been described, the invention is not limited thereto. For example, the communication hole 21 may be formed in a triangular shape having at least three edge lines, or in a polygonal shape having more than four edge lines. In the above embodiments, the exemplary liquid ejecting head of a thin film type which is manufactured by applying a film forming process and lithography process is described. However, the invention can be applied to a liquid ejecting head of a thick film type which is manufactured by a technique such as bonding a green sheet.

Further, in the above embodiments, the liquid ejecting head is described as an example of the liquid ejecting head of the invention. However, the basic configuration of the invention is not limited to the above embodiments. The invention is directed to liquid ejecting heads in general, and as a matter of course, the invention may be applied to liquid ejecting heads that eject a liquid other than ink. Examples of other liquid ejecting heads include, for example, various recording heads used for image recording apparatuses for printers and the like, color material ejecting heads used for manufacturing of the color filters for liquid crystal displays and the like, organic EL displays, electrode material ejecting heads used for forming electrode such as field emission displays (FED), and bioorganic ejecting heads used for manufacturing biochips and the like.

The entire disclosure of Japanese Patent Application No. 2012-271110, filed Dec. 12, 2012 are expressly incorporated by reference herein.

What is claimed is:

1. A liquid ejecting head comprising:

a nozzle plate having a plurality of nozzles through which liquid is ejected;

a flow path forming substrate having a plurality of pressure chambers which are arranged side by side in a first direction, each of the pressure chambers having a first opening provided on a bottom surface, and a piezoelectric element which is provided adjacent the pressure chamber; and a communication plate that is located between the nozzle plate and the flow path forming substrate and has a communication hole which communicates the nozzle and the first opening of the pressure chamber with each other, the nozzle plate, the flow path forming substrate and the communication plate being bonded to each other, wherein the first opening on the flow path forming substrate has a longitudinal direction in a second direction which is perpendicular to the first direction and extends from an ink supply side to the communication hole, and, in the longitudinal direction, the first opening has a narrowed portion at a portion close to the communication hole, the narrowed portion having an inner width of the pressure chamber in the first direction which is smaller than the inner width of a portion on the ink supply side, the communication hole of the communication plate has at least three edge lines which extend in a penetration direction, and the communication plate is bonded to the flow path forming substrate such that ends of the edge lines at a surface close to the flow path forming substrate are covered with the flow path forming substrate that defines the narrowed portion on a surface close to the communication plate.

2. The liquid ejecting head according to claim 1, wherein the communication hole has a second opening that is open to the surface close to the flow path forming substrate and a third opening that is open to a surface close to the nozzle plate, and a narrow flow path is formed at a position between the second opening and the third opening of the communication hole, the narrow flow path having an inner width in the first direction which is smaller than an inner width of either the second opening or the third opening.

3. The liquid ejecting head according to claim 2, wherein the communication hole has a resistance adjustment portion having an inner width in the second direction which is larger than an inner width of the second opening in the second direction, the second direction being perpendicular to the first direction.

4. The liquid ejecting head according to claim 1, wherein the communication hole is formed in a rectangular shape having four edge lines.

5. A liquid ejecting apparatus comprising the liquid ejecting head according to claim 1.

* * * * *